US006031708A

United States Patent [19]

Guermeur

[11] Patent Number: 6,031,708

[45] Date of Patent: Feb. 29, 2000

[54] INDUCTIVE CHARGE CONTROL DEVICE

[75] Inventor: Yves Guermeur, Evreux, France

[73] Assignee: Schneider Electric SA, Boulogne Billancourt, France

[21] Appl. No.: 09/147,177

[22] PCT Filed: Dec. 22, 1998

[86] PCT No.: PCT/FR97/00733

§ 371 Date: Oct. 23, 1998

§ 102(e) Date: Oct. 23, 1998

[87] PCT Pub. No.: WO97/40509

PCT Pub. Date: Oct. 30, 1997

[30] Foreign Application Priority Data

Apr. 25, 1996 [FR] France ..... 96 05404

[51] Int. Cl.[7] ..... H01H 47/04; H01H 47/32

[52] U.S. Cl. ..... 361/160; 361/159

[58] Field of Search ..... 361/159, 160, 361/170, 189, 190

[56] References Cited

U.S. PATENT DOCUMENTS

| | | | |
|---|---|---|---|
| 4,947,283 | 8/1990 | Kono | 361/190 |
| 4,949,215 | 8/1990 | Studtmann et al. | 361/160 |
| 5,953,198 | 9/1999 | Murata et al. | 361/160 |

*Primary Examiner*—Fritz Fleming
*Attorney, Agent, or Firm*—Oblon, Spivak, McClelland, Maier & Neustadt, P.C.

[57] ABSTRACT

Apparatus for controlling an inductive load, particularly for a coil of an electromagnet, including an electronic chopper switch fitted in series with the coil and controlled by a pulse width modulator, and an opening switch, also fitted in series with the coil. A transformer converter 20 with two secondary windings, one of which is connected to the modulator 11, and the other is connected to the gate of the opening transistor T2 via a switch 25 solicited by the opening signal.

5 Claims, 1 Drawing Sheet

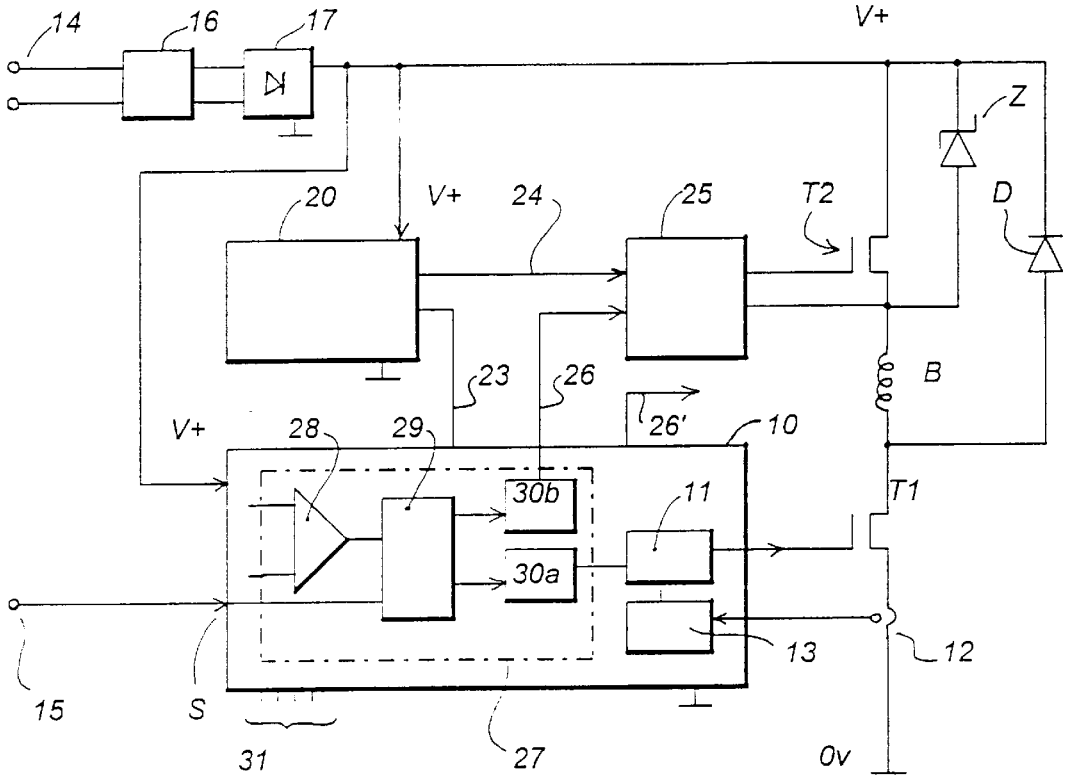
FIG.1
FIG.2
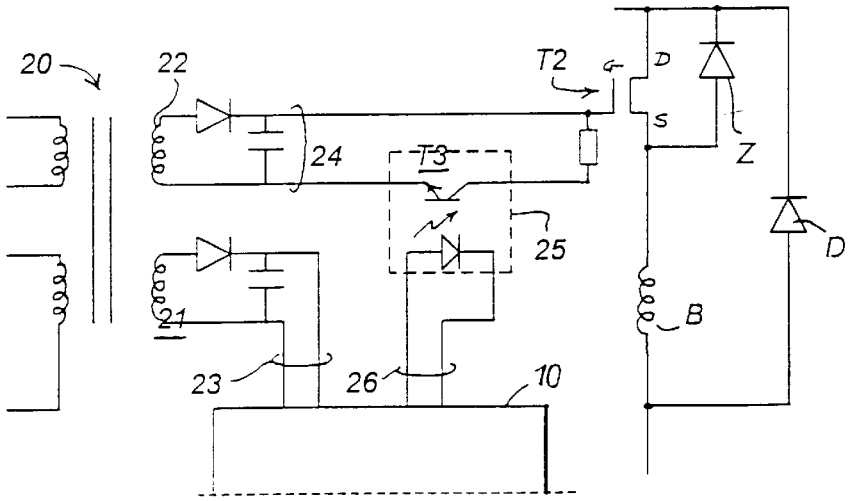

INDUCTIVE CHARGE CONTROL DEVICE

This invention relates to an apparatus for controlling an inductive load, in particular the coil of an electromagnet, to which a recuperation diode is associated, this apparatus including an electronic chopper switch fitted in series with the coil and controlled by a pulse width modulator in accordance with a signal supplied by a device which measures the current of the coil.

Coil control apparatus of this type are well-known. The switch is controlled by the pulse width modulator and permits the coil to be initially powered with a high current, known as a signal current, to close the magnetic circuit of the electromagnet, then with a lower retaining current which is just sufficient to keep the magnetic circuit closed. Furthermore, it is known that the pulse width modulator is powered by a D.C. voltage circuit from a D.C. source or from the mains system.

In such an apparatus, rapid opening of the magnetic circuit of the electromagnet is sometimes sought; whereas in fact the free-wheeling current which continues to flow in the coil via the recuperation diode after the chopper transistor has been blocked slows down this opening. Therefore, using known methods, a second transistor known as rapid opening or rapid fall is connected in series or in parallel with the coil, and is solicited by an opening control circuit (for example, see the document DE 42 27 165).

The purpose of the invention is to permit the rapid opening transistor to be controlled over wide ranges of supply voltages at a voltage which floats with respect to the voltage at the coil terminals.

As claimed by the invention, the power supply circuit of the pulse width modulator is a transformer converter with two secondary windings, one of which is connected to the pulse width modulator and the other to the opening transistor gate by means of an opening switch that is solicited by the opening signal. The opening switch is preferably an optotransistor which leads to the discharging of the capacity of the rapid opening transistor gate when it is opened.

It is advantageously controlled by a circuit which includes a D.C. supply voltage comparator with at least one threshold, the output of the comparator being connected to a signal/retaining timer element and an opening timer device via a logic element fitted with a low level start-stop signal input.

The following description of a non-restrictive embodiment of the invention with regard to the appended Figures will explain how the invention may be put in practice.

FIG. 1 shows diagrammatically a control apparatus according to the invention for a contactor coil.

FIG. 2 shows an example of the embodiment of the opening transistor control of the apparatus shown in FIG. 1.

The apparatus shown is intended to control an electromagnetic contactor coil B or, possibly, the coils of two interdependent contactors associated in a change-over connection. It includes a chopper transistor T1 fitted in series with the coil, between the latter and a low potential point, for example 0 Volt, and a rapid opening transistor T2, also fitted in series with the coil, between the latter and a high potential line V+. A recuperation diode D is fitted in parallel to the series connection of the coil B and the transistor T2. Transistors T1 and T2 should preferably be insulated gate transistors, this concerns MOS transistors, but insulated gate bipolar transistors, known as IGBT's, may also be used. In one variation, coil B is connected directly to the V+ line and the transistor T2 fitted in series with the coil, between the latter and the point where it is connected to the diode D. In another variation, the transistor T2 and the diode D are fitted in series and the coil B in parallel to T2 and D.

The T1 chopper transistor is connected to the output of a pulse modulator circuit 11, which is part of a control circuit 10. A sensor 12 of the current flowing in the coil B is connected to the circuit 11 via a peak current detector 13. The elements which compose or are associated to the circuit 11 are typical and will not be described in further detail. The transistors T1 and T2 are N-channel MOS or IGBT's.

The apparatus has on the one hand 14 power supply and control terminals, which allow the various electronic circuits to be powered and the starting and stopping of the contactor to be determined by means of a contactor- not indicated and, on the other hand, a command terminal 15 which allows the starting and stopping of the contactor to be determined by a low level signal S, which for example may originate from an industrial bus or an appropriate control device such as a programmable logic controller. The power supply and control terminals 14 are connected via a filter 16 to a rectifier 17, the output of which to the V+ potential, hereafter considered as a D.C. potential, is connected to the transistor T2, the control circuit 10 and a transformer converter 20.

As claimed by the invention, the converter 20 has two secondary windings 21 and 22 (see FIG. 2). The windings 21 and 22 are respectively connected via conductors 23 and 24 to the control circuit 10 to power it and to an insulated control opening switch 25; the switch 25, for example an optotransistor, is controlled by the controller 10 via a conductor 26 to make the transistor T2 conductive or not, which supplies or isolates the supply to the coil. The conductor 26 is connected to an opening command circuit 27 which includes an analogue or digital comparator 28 of the voltage applied to the control circuit 10 by the conductor 23. A logic element 29 receives on the one hand the output signal from the comparator 28 and on the other hand, the signal S which is applied to the circuit 10 by the terminal 15; the output from the logic element 29 is connected on the one hand to a signal/retaining timer device 30*a* connected to the modulator 1, and on the other hand, to an opening delay device 30*b*, to which the conductor 26 is connected. The opening delay device 30*b*, for example of the RC type, allows the blocking delay of the transistor T2 to be adjusted and therefore the fall time of the electromagnet.

As may be seen in FIG. 2, the transistor T3 of the optical component 25 is situated so as to allow the capacity of the T2 transistor gate to discharge when T3 is blocked. A Zener diode Z is fitted in parallel to T2 to protect it.

The control circuit 10 may be a micro-controller equipped with inputs 31 to select the rating of the coil of the associated contactor. The micro-controller may also be equipped with inputs and outputs 26, 26', duplicated to control the coils of two contactors associated to one another in a change-over connection.

The apparatus shown operates as follows.

The coil B is supposed to have no power supply initially, so that the magnetic circuit of the electromagnet of the contactor is open. To close the magnetic circuit, the switch not shown is closed, which is connected to the terminals 14, which applies the D.C. voltage V+ to the drain of T2, the control circuit 10 and the converter 20. The transistor of the opening switch 25 is made conductive by the circuit 10 and the gate of the opening transistor T2 is therefore polarised; the result of this is that T2 is conductive and that, since T1 is also conductive, the coil B is powered with a signal current, then a retaining current which is lower than the signal current once the pulse width modulator 11 starts to operate.

To open the magnetic circuit, the switch associated to the terminals 14 is opened, so that the power supply voltage of the circuit drops from its V+ level. When it reaches the threshold of the comparator 28, the delay device 30 applies a signal with the predetermined delay to the optotransistor 25, which is blocked. The gate of T2 is discharged and T2 is blocked. The electromagnet thus falls rapidly. The same operation of rapid opening may also be obtained by switching the low level signal S supplied to the terminal 15.

I claim:

1. Apparatus for controlling an inductive load, particularly for a coil of an electromagnet, to which a recuperation diode is associated, including:

an electronic chopper switch fitted in series with the coil and controlled by a pulse width modulator in accordance with a signal supplied by a device which measures the coil current, the pulse width modulator being supplied by a D.C. voltage supply circuit and included in a control circuit, a rapid opening electronic switch composed of an insulated gate transistor fitted in series with the coil or in parallel to the coil and which may be controlled by an opening signal supplied by the control circuit, characterized by the fact that the power supply circuit (20) of the pulse width modulator (11) is a transformer converter with two secondary windings, one of which (21) is connected to the pulse width modulator and the other (22) is connected to the opening transistor gate (T2) by means of the opening switch (25) solicited by the opening signal.

2. Apparatus of claim 1, characterized by the fact that the opening switch (25) is an optotransistor, the opening of which leads to the discharge of the gate capacity of the rapid opening transistor (T2).

3. Apparatus of claim 1, characterized by the fact that the opening switch (25) is controlled by a comparator (28) of the D.C. supply voltage with at least one threshold, the output of the comparator being connected to a signal/retaining timer device (30*a*) and an opening delay device (30*b*) via a logic element (29) equipped with an input for a low level control signal (S).

4. Apparatus of claim 1, characterized by the fact that the opening transistor (T2) may be shunted.

5. Apparatus of claim 1, characterized by the fact that the control circuit (10) is a micro-controller equipped with inputs (31) for selecting the rating of the contactor coils and inputs and outputs attributed to the coils of the two contactors associated in a change-over connection.

* * * * *